United States Patent [19]

Weston

[11] 3,960,273

[45] June 1, 1976

[54] DISPLAY DEVICE

[76] Inventor: Roy Bernard Weston, 9 Dingle Dell, Leighton Buzzard, England

[22] Filed: Feb. 14, 1975

[21] Appl. No.: 550,880

[52] U.S. Cl. ..... 211/4; 211/40; 211/165; 211/169

[51] Int. Cl.[2] ..... E05B 73/00; A47F 5/12

[58] Field of Search ..... 211/4, 40, 96, 110, 211/163, 165, 166, 168, 169, 116; 312/9, 10, 11, 12, 13, 14, 123, 130, 133, 136, 138 A; 248/289

[56] References Cited

UNITED STATES PATENTS

| | | | |
|---|---|---|---|
| 646,388 | 3/1900 | Moore | 211/163 |
| 887,882 | 5/1908 | Waugh | 211/169 |
| 1,049,886 | 1/1913 | Manson | 211/165 |
| 1,251,254 | 12/1917 | Lough | 211/169 |
| 1,314,887 | 9/1919 | Miano | 211/40 |
| 1,569,365 | 1/1926 | Goldberg | 211/163 |
| 2,008,115 | 7/1935 | Taylor | 211/169 X |
| 3,478,893 | 11/1969 | Grosslen | 211/165 |
| 3,565,260 | 2/1971 | Stewart | 248/203 X |
| 3,661,273 | 5/1972 | Grosslen | 211/163 X |
| 3,820,862 | 6/1974 | Crosslen | 312/123 |

*Primary Examiner*—Roy D. Frazier
*Assistant Examiner*—Thomas J. Holko
*Attorney, Agent, or Firm*—Hirons & Rogers

[57] ABSTRACT

A display device for articles such as audio cassettes and cartridges, the device having at least one vertically disposed wing-like member in the form of a frame with an opening through which the articles can be inserted into or removed from the frame, the frame being pivotally mounted about a first axis on an arm which itself is pivotable about a further axis parllel to the first axis, the first axis being an axis of a vertical pin on the arm, the further axis being an axis of a rod to which the arm is fixed, means being provided for locking the frame in relation to the arm so that the opening remains in the proximity of a blocking means said opening despite joints pivoting movement of the frame and the arm about the further axis, the frame being movable about the first axis so as to remove the opening from the proximity of the blocking means, only after release of the said locking means enables movement of the frame relative to the arm.

6 Claims, 2 Drawing Figures

DISPLAY DEVICE

BACKGROUND OF THE INVENTION

The invention relates to display devices for displaying articles in such a manner as to prevent their unauthorised removal from the display device. More particularly, the invention relates to a display device for audio cassettes and/or cartridges.

It is desirable to be able to display audio cassettes and cartridges, or other articles, in such a manner that they can be readily perused by a prospective purchaser without, however, being removed by the prospective purchaser from the display device.

SUMMARY OF THE INVENTION

Thus, it is a purpose of this invention to provide a display device which enables articles such as audio cassettes and/or cartridges to be displayed while at the same time the unathorised removal of said articles is prevented.

The invention consists in a display device comprising a vertically disposed wing-like member for receiving articles to be displayed, the wing-like member being pivotally mounted about an axis substantially parallel to the plane of the wing-like member, on a vertical pin on an arm which itself is pivotable about a further axis parallel to the first said axis, said further axis being an axis of a rod to which the arm is fixed, locking means comprising a hook formation being provided for cooperating with a portion of the arm so as to maintain the wing-like member fixed relative to the arm, the wing-like member being in the form of a frame or other structure having an opening or openings through which the said articles can be inserted or removed, means being provided for effectively blocking said opening or openings when the said locking means are operative whereby to allow swinging of the said wing-like member about a said further axis for inspection of the display articles, without the articles being free for removal, the articles being removable only after release of the locking means and swinging of the wing-like member about the first said axis relative to the arm, whereby to move the said opening or openings away from the said blocking means.

In a preferred arrangement, a plurality of such wing-like members are provided, although it should be understood that a single wing-like member is also within the scope of the invention.

BRIEF DESCRIPTION OF THE DRAWINGS

There follows a detailed description of the preferred embodiment to be read with reference to the accompanying drawings which are given by way of example and in which.

Figure 1:
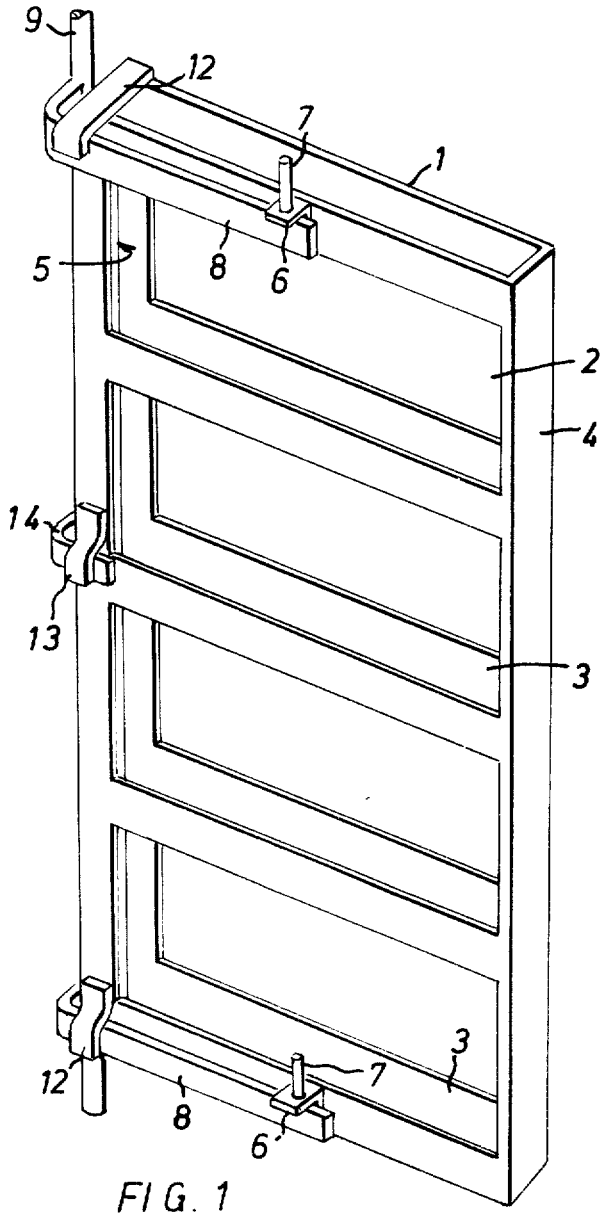
FIG. 1 is a perspctive view of a wing-like member forming part of the display device of the invention.

DETAILED DESCRIPTION OF THE PREFERRED EMBODIMENT:

Referring now to the drawings, like numerals represent like elements throughout the two views.

The display device comprises a wing-like member 1 which may be made of metal or plastics material and which has a plurality of compartments 2 in which articles to be displayed are provided, for example, audio cassettes and/or cartridges. The compartments 2 are closed at the top and bottom by channel-shaped portions 3 of the wing-like member and are closed at one end by an end portion 4 of the wing-like member. The compartments 2 are open at their other end 5, the openings allowing insertion and removal of the articles from the compartment 2.

The wing-like member 1 is pivotally mounted about a vertical axis by two brackets 6 which engage over pivot pins 7 provided at ends of arms 8. The arms 8 are fixed by their other ends to a vertically disposed rod 9 which extends between an upper flange 10 and a lower flange 11. Thus, the wing-like member 1 is pivotable about the axis through pins 7 and is also pivotable about the axis of the rod 9.

Locking means are provided for normally preventing the pivotal movement of the wing-like member 1 about the pins 7, these locking means being provided by hook formations 12 which normally engage over regions of the arms 8 close to the rod 9. A further hook formation 13 is provided on the wing-like member 1 which normally engages over an arm 14 also fixed to the rod 9.

It will be seen from FIG. 1 that the wing-like member 1 can be freed for rotation about the pins 7 only after the wing-like member has been lifted, for example manually, to an extend sufficient to clear the hooks 12 and 13 from the arms 8 and 14.

It will be seen that when the locking means are operative, that is to say, in the position shown in FIG. 1, the rod 9 extends close to the openings 5 and prevents any removal of articles from the compartments 2. However, such removal is possible when the locking means constituted by the hook formations 12 and 13 are overcome and the region of the wing-like member 1 which normally is in the proximity of the rod 9 is swung away therefrom about the pivot pins 7, so as to render the openings 5 freely accessible.

Figure 2:
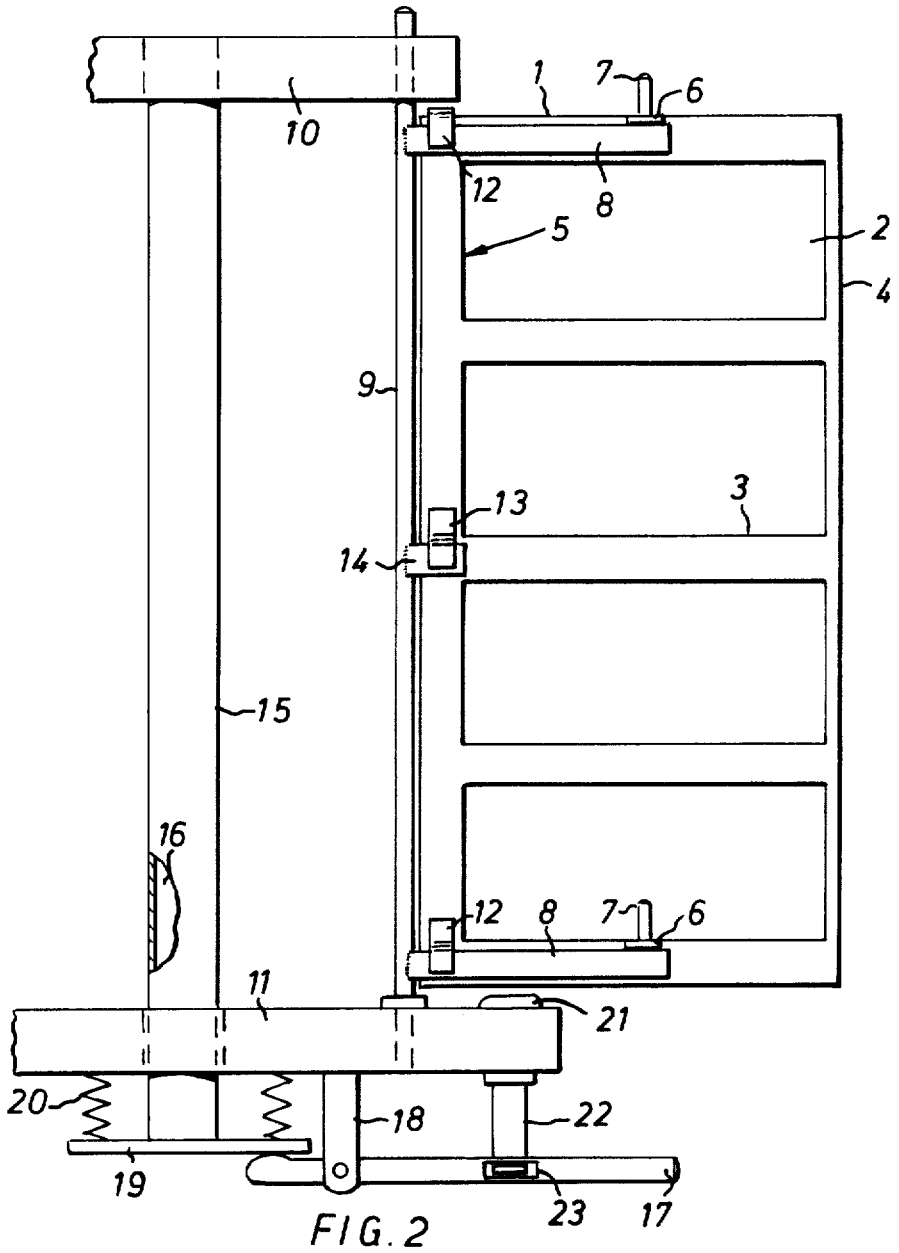
FIG. 2 is a part sectional side view showing the arrangement of the wing-like member in a display stand.

As will be seen from FIG. 2 the upper flange 10 normally prevents lifting of the wing-like member 1 to an extent sufficient to clear the hook formations from the corresponding arms. However, the upper flange 10 is fixedly mounted on supporting tube 15 which is vertically slidable on a guide rod 16 to which the lower flange 11 is connected. An actuating lever 17 is pivotally mounted on the underside of the lower flange 11 by brackets 18 and engages a plate 19 fixed to the supporting tube 15, compression springs 20 being interposed between the plate 19 and the lower flange 11. On downward movement of the handle of the lever 17 the plate 19 is urged upwardly against the springs 20, the tube 15 and upper flange 10 thus also being urged upwardly, the extent of movement being sufficient to allow the above described upward movement of the wing-like member 1. A key operable lock 21 is mounted in the lower flange 11 and has a cranked arm 22 which in one position of the lock engages in slots 23 in the lever 17 whereby to prevent unauthorised operation of the lever 17 for raising the upper flange 10. By suitably arranging the geometry of the lever 17 and the cranked arm 22 it may also be arranged that the lock 21 can be used to maintain the lever 17 in such a position that the upper flange 10 is permanently held in its raised position, this being particularly advantageous when inserting or removing all of the articles rather than just one or two thereof.

The flanges 10 and 11 will normally carry a plurality of the wing-like members, for example, fifteen, each being as described above and each being mounted by means of an individual rod 9. The entire unit of upper flange 10, supporting tube 15 and lower flange 11 is preferably rotatably mounted by means not shown, thus facilitating perusal of the displayed articles by enabling the device to be rotated by the prospective purchaser while looking at the articles displayed in the various wing-like members.

Modifications are possible. For example, blocking means other than the rod 9 may be provided for effectively blocking the openings 5. Also, the rod 9 may be mounted by means other than the flanges 10 and 11, for example, by brackets suitably mounted on a wall or the like.

I claim:

1. A display device comprising a vertically disposed wing-like member for receiving articles to be displayed; an arm; a vertically disposed rod to which the arm is fixed by one end; a pin extending vertically from the other end of the arm; means cooperating with said pin and pivotally mounting the wing-like member on said arm about a first axis which is provided by said pin and which is substantially parallel to the plane of said wing-like member; means mounting said rod for rotary movement enabling pivoting said arm about a further axis which is an axis of said rod and which is parallel to said first axis; releasable locking means comprising a hook formation provided on the wing-like member at a region thereof close to the rod, the hook formation cooperating with a portion of the arm, to maintain said wing-like member fixed relative to said arm, the action of the locking means being releasable by lifting the wing-like member to an extent sufficient to clear the hook formation from the arm, while maintaining the engagement of the wing-like member with said pin; said wing-like member being in the form of a frame structure with means defining an opening through which the said articles can be inserted and removed; and blocking means effectively blocking said opening when the said locking means are operative, said rod mounting means allowing swinging of the said wing-like member jointly with said arm about said further axis for inspection of the display articles, without the articles being free for removal, the articles being removable only after release of the locking means and swinging of the wing-like member about the said first axis relative to said arm, whereby to move the said opening away from said blocking means.

2. A display device according to claim 1, wherein the blocking means are provided by a portion of the said rod extending in the proximity of the said opening.

3. A display according to claim 1, wherein said arm is arranged at an upper region of the wing-like member and a corresponding further arm is arranged at the lower region of the wing-like member, both arms being fixed by one end to the rod.

4. A display device according to claim 1, wherein the rod extends vertically between a lower flange together constituting said rod mounting means and an upper flange, the upper flange normally preventing upward manual movement of the wing-like member such as is necessary to release the action of the locking means, but being arranged for upward movement whereby to allow said upward movement of the wing-like member when desired.

5. A display according to claim 4, wherein the upper flange is upwardly movable by an operating lever, a lock being provided for preventing unauthorised movement of the operating lever.

6. A display device according to claim 4, wherein a plurality of said wing-like members are provided, each mounted between the upper and lower flanges by means of its respective rod.

* * * * *